US011773341B2

(12) United States Patent
Chommeloux et al.

(10) Patent No.: US 11,773,341 B2
(45) Date of Patent: Oct. 3, 2023

(54) LUBRICATING OIL COMPOSITIONS

(71) Applicant: Chevron Oronite Company LLC, San Ramon, CA (US)

(72) Inventors: Claire Chommeloux, San Francisco, CA (US); Alexander Boffa, Oakland, CA (US)

(73) Assignee: CHEVRON ORONITE COMPANY LLC, San Ramon, CA (US)

( * ) Notice: Subject to any disclaimer, the term of this patent is extended or adjusted under 35 U.S.C. 154(b) by 0 days.

(21) Appl. No.: 16/443,971

(22) Filed: Jun. 18, 2019

(65) Prior Publication Data

US 2019/0390130 A1 Dec. 26, 2019

Related U.S. Application Data

(60) Provisional application No. 62/688,567, filed on Jun. 22, 2018.

(51) Int. Cl.

| | |
|---|---|
| ***C10M 133/44*** | (2006.01) |
| ***C10M 139/06*** | (2006.01) |
| *C10N 30/00* | (2006.01) |
| *C10N 40/25* | (2006.01) |

(52) U.S. Cl.

CPC ..... *C10M 133/44* (2013.01); *C10M 139/06* (2013.01); *C10M 2215/223* (2013.01); *C10N 2030/36* (2020.05); *C10N 2040/25* (2013.01)

(58) Field of Classification Search

CPC ..... C10M 133/44; C10M 139/06; C10M 2215/223; C10M 2203/1025; C10M 2215/28; C10M 133/56; C10M 169/04; C10N 2030/36; C10N 2040/25; C10N 2060/14; C10N 2030/041; C10N 2030/52; C10N 2040/252; C10N 2020/02

USPC ..... 508/192

See application file for complete search history.

(56) References Cited

U.S. PATENT DOCUMENTS

| | | | |
|---|---|---|---|
| 3,172,892 | A | 3/1965 | Le Suer et al. |
| 3,219,666 | A | 11/1965 | Le Suer et al. |
| 3,272,746 | A | 9/1966 | Le Suer et al. |
| 4,234,435 | A | 11/1980 | Meinhardt et al. |
| 4,482,464 | A | 11/1984 | Karol et al. |
| 4,521,318 | A | 6/1985 | Karol |
| 4,617,138 | A | 10/1986 | Wollenberg |
| 4,645,515 | A | 2/1987 | Wollenberg |
| 4,668,246 | A | 5/1987 | Wollenberg |
| 4,963,275 | A | 10/1990 | Gutierrez et al. |
| 5,356,552 | A | 10/1994 | Harrison et al. |
| 6,001,780 | A | 12/1999 | Ho et al. |
| 6,165,235 | A | 12/2000 | Kolp et al. |
| 6,440,905 | B1 | 8/2002 | Epps et al. |
| 2011/0245118 | A1 | 10/2011 | Nelson et al. |
| 2015/0322368 | A1* | 11/2015 | Patel et al. ..... C10M 133/16 |

FOREIGN PATENT DOCUMENTS

| | | |
|---|---|---|
| WO | 199916852 | 4/1999 |

OTHER PUBLICATIONS

International Search Report, dated Nov. 29, 2019, during the prosecution of International Application No. PCT/IB2019/055078.

Written Opinion of the International Searching Authority, dated Nov. 29, 2019, during the prosecution of International Application No. PCT/IB2019/055078.

* cited by examiner

*Primary Examiner* — Prem C Singh
*Assistant Examiner* — Francis C Campanell

(57) ABSTRACT

Disclosed is a lubricating oil composition comprising (a) a major amount of an oil of lubricating viscosity having a kinematic viscosity at 100° C. in a range of about 2 to about 50 $mm^2/s$; (b) a hydrocarbyl succinimide dispersant; (c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

20 Claims, No Drawings

LUBRICATING OIL COMPOSITIONS

TECHNICAL FIELD

The disclosed technology relates to lubricants for internal combustion engines, particularly those for compression ignition engines.

BACKGROUND OF THE DISCLOSURE

Lubricating oil compositions used to lubricate internal combustion engines and transmissions contain a major amount of a base oil of lubricating viscosity, or a mixture of such oils, and one or more lubricating oil additives to improve the performance characteristics of the oil. For example, lubricating oil additives are used to improve detergency, to reduce engine wear, to provide stability against heat and oxidation, to reduce oil consumption, to inhibit corrosion, to act as a dispersant, and to reduce friction loss. Some additives provide multiple benefits such as, for example dispersant-viscosity modifiers.

Among the additives are dispersants which, as their name indicates, are used to provide engine cleanliness and to keep, for example, carbonate residues, carboxylate residues, carbonyl residues, soot, etc., in suspension. The most widely used dispersants today are products of the reaction of succinic anhydrides substituted in alpha position by an alkyl chain of polyisobutylene (PIBSA) type with a polyalkylene amine, optionally post-treated with a boron derivative, ethylene carbonate or other post-treatment reagents known in the specialized literature.

Among the polyamines used, polyalkylene-amines are preferred, such as diethylene triamine (DETA), triethylene tetramine (TETA), tetraethylene pentamine (TEPA), pentaethylene hexamine (PEHA) and heavier poly-alkylene-amines (HPA).

These polyalkylene amines react with the succinic anhydrides substituted by alkyl groups of polyisobutylene (PIBSA) type to produce, according to the molar ratio of these two reagents, mono-succinimides, bis-succinimides or mixtures of mono- and bis-succinimides Such reaction products, optionally post-treated, generally have a non-zero basic nitrogen content of the order of 5 to 50, as measured by the total base number or TBN, expressed as mg of KOH per gram of sample, which enables them to protect the metallic parts of an engine while in service from corrosion by acidic components originating from the oxidation of the lubricating oil or the fuel, while keeping the said oxidation products dispersed in the lubricating oil to prevent their agglomeration and their deposition onto metal parts.

Dispersants of mono-succinimide or bis-succinimide type are even more effective if their relative basic nitrogen content is high, i.e. in so far as the number of nitrogen atoms of the polyamine is larger than the number of succinic anhydride groups substituted by a polyisobutenyl group.

However, the higher the basic nitrogen content of these dispersants, the more they favor the attack of the fluorocarbon elastomer seals used in modern engines, because the basic nitrogen tends to react with the acidic hydrogen atoms of this type of seal, and this attack results in the formation of cracks in the elastomer surface and the loss of other physical properties sought in this type of material.

Accordingly, it would be desirable to develop lubricating oil compositions which contain dispersants effective for soot dispersancy while exhibiting improved fluorocarbon elastomer seal compatibility.

SUMMARY OF THE INVENTION

In accordance with one illustrative embodiment, there is provided a lubricating oil composition which comprises:

(a) a major amount of an oil of lubricating viscosity having a kinematic viscosity at 100° C. in a range of about 2 to about 50 $mm^2/s$;

(b) a hydrocarbyl succinimide dispersant;

(c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

In accordance with a second illustrative embodiment, there is provided a method comprising operating an internal combustion engine with a lubricating oil composition comprising (a) a major amount of an oil of lubricating viscosity having a kinematic viscosity at 100° C. in a range of about 2 to about 50 $mm^2/s$; (b) a hydrocarbyl succinimide dispersant; (c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

In accordance with a third illustrative embodiment, there is provided a method for maintaining or improving compatibility of a fluorocarbon elastomer seal with a lubricating oil composition in an internal combustion engine containing one or more fluorocarbon elastomer seals, the method comprising operating the engine with a lubricating oil composition comprising (a) a major amount of an oil of lubricating viscosity having a kinematic viscosity at 100° C. in a range of about 2 to about 50 $mm^2/s$; (b) a hydrocarbyl succinimide dispersant; (c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

The lubricating oil composition of the present disclosure advantageously improves compatibility of a fluorocarbon elastomer seal while also being effective for soot dispersancy.

DETAILED DESCRIPTION OF THE PREFERRED EMBODIMENTS

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

In this specification, the following words and expressions, if and when used, have the meanings given below.

A "major amount" means in excess of 50 wt. % of a composition.

"Active ingredients" or "actives" refer to additive material that is not diluent or solvent.

All percentages reported are weight % on an active ingredient basis (i.e., without regard to carrier or diluent oil) unless otherwise stated.

The term "ppm" means parts per million by weight, based on the total weight of the lubricating oil composition.

High temperature high shear (HTHS) viscosity at 150° C. was determined in accordance with ASTM D4683.

Kinematic viscosity at 100° C. ($KV_{100}$) was determined in accordance with ASTM D445.

The term "metal" refers to alkali metals, alkaline earth metals, or mixtures thereof.

The term "alkali metal" refers to lithium, sodium, potassium, rubidium, and cesium.

The term "alkaline earth metal" refers to calcium, barium, magnesium, and strontium.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test.

Phosphorus and sulfur contents were determined in accordance with ASTM D5185.

The present disclosure is directed to a lubricating oil composition which comprises: (a) a major amount of an oil of lubricating viscosity having a kinematic viscosity at 100° C. in a range of about 2 to about 50 $mm^2/s$; (b) a hydrocarbyl succinimide dispersant; (c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

In general, the level of sulfur in the lubricating oil compositions of the present disclosure is less than or equal to about 0.7 wt. %, based on the total weight of the lubricating oil composition, e.g., a level of sulfur of about 0.01 wt. % to about 0.70 wt. %, or about 0.01 wt. % to about 0.6 wt. %, or about 0.01 wt. % to about 0.5 wt. %, or about 0.01 wt. % to about 0.4 wt. %, or about 0.01 wt. % to about 0.3 wt. %, or about 0.01 wt. % to about 0.2 wt. %, or about 0.01 wt. % to about 0.10 wt. %, based on the total weight of the lubricating oil composition. In one embodiment, the level of sulfur in the lubricating oil compositions of the present disclosure is less than or equal to about 0.60 wt. %, or less than or equal to about 0.50 wt. %, or less than or equal to about 0.40 wt. %, or less than or equal to about 0.30 wt. %, or less than or equal to about 0.20 wt. %, or less than or equal to about 0.10 wt. % based on the total weight of the lubricating oil composition.

In one embodiment, the level of phosphorus in the lubricating oil compositions of the present disclosure is less than or equal to about 0.12 wt. %, based on the total weight of the lubricating oil composition, e.g., a level of phosphorus of about 0.01 wt. % to about 0.12 wt. %. In one embodiment, the level of phosphorus in the lubricating oil compositions of the present disclosure is less than or equal to about 0.11 wt. %, based on the total weight of the lubricating oil composition, e.g., a level of phosphorus of about 0.01 wt. % to about 0.11 wt. %. In one embodiment, the level of phosphorus in the lubricating oil compositions of the present disclosure is less than or equal to about 0.10 wt. %, based on the total weight of the lubricating oil composition, e.g., a level of phosphorus of about 0.01 wt. % to about 0.10 wt. %. In one embodiment, the level of phosphorus in the lubricating oil compositions of the present disclosure is less than or equal to about 0.09 wt. %, based on the total weight of the lubricating oil composition, e.g., a level of phosphorus of about 0.01 wt. % to about 0.09 wt. %. In one embodiment, the level of phosphorus in the lubricating oil compositions of the present disclosure is less than or equal to about 0.08 wt. %, based on the total weight of the lubricating oil composition, e.g., a level of phosphorus of about 0.01 wt. % to about 0.08 wt. %. In one embodiment, the level of phosphorus in the lubricating oil compositions of the present disclosure is less than or equal to about 0.07 wt. %, based on the total weight of the lubricating oil composition, e.g., a level of phosphorus of about 0.01 wt. % to about 0.07 wt. %. In one embodiment, the level of phosphorus in the lubricating oil compositions of the present disclosure is less than or equal to about 0.05 wt. %, based on the total weight of the lubricating oil composition, e.g., a level of phosphorus of about 0.01 wt. % to about 0.05 wt. %.

In one embodiment, the level of sulfated ash produced by the lubricating oil compositions of the present disclosure is less than or equal to about 1.60 wt. % as determined by ASTM D 874, e.g., a level of sulfated ash of from about 0.10 wt. % to about 1.60 wt. % as determined by ASTM D 874. In one embodiment, the level of sulfated ash produced by the lubricating oil compositions of the present disclosure is less than or equal to about 1.00 wt. % as determined by ASTM D 874, e.g., a level of sulfated ash of from about 0.10 wt. % to about 1.00 wt. % as determined by ASTM D 874. In one embodiment, the level of sulfated ash produced by the lubricating oil compositions of the present disclosure is less than or equal to about 0.80 wt. % as determined by ASTM D 874, e.g., a level of sulfated ash of from about 0.10 wt. % to about 0.80 wt. % as determined by ASTM D 874. In one embodiment, the level of sulfated ash produced by the lubricating oil compositions of the present disclosure is less than or equal to about 0.60 wt. % as determined by ASTM D 874, e.g., a level of sulfated ash of from about 0.10 wt. % to about 0.60 wt. % as determined by ASTM D 874.

The lubricating oil composition in accordance with the present disclosure includes an oil of lubricating viscosity (sometimes referred to as "base stock" or "base oil"). The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The oil of lubricating viscosity is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), and poly(1-decenes)); alkylbenzenes (e.g., dodecylbenzenes, tetradecylbenzenes, dinonylbenzenes, and di(2-ethylhexyl) benzenes); alkylated naphthalene; polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, and phthalic acid) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, or greater than about 70 wt. %, or great than about 80%, based on the total weight of the lubricating oil composition. In one embodiment, the oil of lubricating viscosity can be present in the lubricating oil composition of this disclosure in an amount of less than about 90 wt. % or less than about 85 wt. %, based on the total weight of the lubricating oil composition. The base oil for use herein can be any presently known or later-discovered oil of lubricating viscosity used in formulating lubricating oil compositions for engine oils. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The topology of viscosity modifier could include, but is not limited to, linear, branched, hyperbranched, star, or comb topology.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, or about 3 cSt to about 16 cSt, or about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

The lubricating oil composition has a viscosity index of at least 135 (e.g., 135 to 400, or 135 to 250), or at least 150 (e.g., 150 to 400, or 150 to 250), or at least 165 (e.g., 165 to 400, or 165 to 250), or at least 190 (e.g., 190 to 400, or 190 to 250), or at least 200 (e.g., 200 to 400, or 200 to 250). If the viscosity index of the lubricating oil composition is less than 135, it may be difficult to improve fuel efficiency while maintaining the HTHS viscosity at 150° C. If the viscosity index of the lubricating oil composition exceeds 400, evaporation properties may be reduced, and deficits due to insufficient solubility of the additive and matching properties with a seal material may be caused.

The lubricating oil composition in accordance with the present disclosure further includes a hydrocarbyl succinimide dispersant. In general, a hydrocarbyl succinimide dispersant includes, for example, a hydrocarbyl mono and polysuccinimide. Certain fundamental types of succinimides and the related materials encompassed by the term of art "succinimide" are taught in U.S. Pat. Nos. 3,172,892; 3,219,666; and 3,272,746, the disclosures of which are incorporated by reference herein. The term "succinimide" is understood in the art to include many of the amide, imide, and amidine species which may also be formed. The predominant product however is a succinimide and this term has been generally accepted as meaning the product of a reaction of a hydrocarbyl succinic acid or anhydride with a nitrogen-containing compound.

In one embodiment, the hydrocarbyl succinimides, because of their commercial availability, are those succinimides prepared from a hydrocarbyl succinic anhydride and a polyamine. For example, a suitable anhydride can be represented by the structure of formula I:

(I)

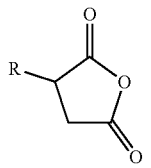

wherein R is a hydrocarbyl group containing from about 12 to about 350 carbon atoms. Suitable polyamines for use in preparing the succinimide include, for example, polyalkylene polyamines, including polyalkylene diamines. Such polyalkylene polyamines will typically contain about 2 to about 12 nitrogen atoms and about 2 to 24 carbon atoms. In one embodiment, suitable polyalkylene polyamines are those having the formula: $H_2N—(R^1NH)_c—H$ wherein $R^1$ is a straight- or branched-chain alkylene group having 2 or 3 carbon atoms and c is 1 to 9. Representative examples of suitable polyalkylene polyamines include ethylenediamine, diethylenetriamine, triethylenetetraamine, tetraethylenepentamine and mixtures thereof.

Many of the polyamines suitable for use in the present invention are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99 116.

In one illustrative embodiment, a hydrocarbyl succinimide dispersant is obtained by reaction of a polyisobutenyl succinic anhydride (PIBSA) and a polyamine. In another embodiment, a hydrocarbyl succinimide dispersant is obtained by reaction of a PIBSA and a polyamine, wherein the PIBSA is produced from polybutene and maleic anhydride (such as by a thermal reaction method using neither chlorine or a chlorine atom-containing compound). In another embodiment, a hydrocarbyl succinimide dispersant is a succinimide reaction product of the condensation reaction between a PIBSA and one or more alkylene polyamines. The PIBSA, in this embodiment, can be the thermal reaction product of high methylvinylidene polyisobutene (PIB) and maleic anhydride.

In one embodiment, a hydrocarbyl succinimide dispersant is a primarily bis-succinimide reaction product derived from a PIB having a number average molecular weight (Mn) of about 500 to about 3000. In one embodiment, a PIB has a Mn of from about 700 to 2700. In another embodiment, a hydrocarbyl succinimide dispersant is a primarily bis-succinimide reaction product derived from a PIB having a Mn of at least about 600, or at least about 800, or at least about 1000, or at least about 1100, or at least about 1200, or at least about 1300, or at least about 1400, or at least about 1500, or at least about 1600, or at least about 1700, or at least about 1800, or at least about 1900, or at least about 2000, or at least about 2100, or at least about 2200, or at least about 2300, or at least about 2400, or at least about 2500, or at least about 2600, or at least about 2700, or at least about 2800, or at least about 2900, or at least about 3000. In another embodiment, a hydrocarbyl succinimide dispersant is a primarily bis-succinimide reaction product derived from a PIB having a Mn of no more than 5000, or no more than about 4000 or no more than about 3500 or no more than about 3000 or no more than about 2700 or no more than about 2500.

In one embodiment, the hydrocarbyl succinimide is prepared from a polyisobutenyl succinic anhydride of about 70 to about 128 carbon atoms and tetraethylene pentamine or triethylene tetramine or mixtures thereof.

Methods for preparing a hydrocarbyl succinimide dispersant are well known in the art. For example, one or more hydrocarbyl succinic acid or anhydride and one or more amines can be heated and water is removed, optionally in the presence of a substantially inert organic liquid solvent/diluent. The reaction temperature can range from about 80° C. up to the decomposition temperature of the mixture or the product, which typically falls between about 100° C. to about 300° C. The amount of hydrocarbyl succinic acid or anhydride employed in the reaction can range from about 30 to about 95 wt. % or from about 40 to about 60 wt. %, based on the total weight of the reaction mixture. Additional details and examples of procedures for preparing a hydrocarbyl succinimide dispersant include those described in, for example, U.S. Pat. Nos. 3,172,892, 3,219,666, 3,272,746, 4,234,435, 6,165,235 and 6,440,905.

In general, the hydrocarbyl succinimide dispersant is present in the lubricating oil composition in accordance with the present disclosure in an amount of about 0.5 wt. % to about 12 wt. %, based on the total weight of the lubricating oil composition. In another embodiment, the hydrocarbyl succinimide dispersant is present in the lubricating oil composition in accordance with the present disclosure in an amount of about 0.5 wt. % to about 5 wt. %, based on the total weight of the lubricating oil composition. In another embodiment, the hydrocarbyl succinimide dispersant is present in the lubricating oil composition in accordance with the present disclosure in an amount of about 0.5 wt. % to about 4 wt. %, based on the total weight of the lubricating oil composition.

The lubricating oil composition in accordance with the present disclosure further includes a borated hydrocarbyl succinimide dispersant. In general, the borated hydrocarbyl succinimide dispersant is one in which a hydrocarbyl succinimide dispersant is treated with a source of boron as known in the art. In general, a hydrocarbyl succinimide dispersant to be post treated with a source of boron includes, for example, a hydrocarbyl mono and polysuccinimide. As discussed above, certain fundamental types of succinimides and the related materials encompassed by the term of art "succinimide" are taught in U.S. Pat. Nos. 3,172,892; 3,219,666; and 3,272,746, the disclosures of which are incorporated by reference herein.

In one embodiment, the hydrocarbyl succinimides, because of their commercial availability, are those succinimides prepared from a hydrocarbyl succinic anhydride and a polyamine. Methods for preparing a hydrocarbyl succinimide dispersant are well known in the art as discussed above. For example, a suitable anhydride can be represented by the structure of formula I:

(I)

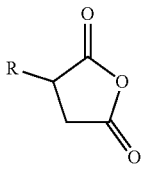

wherein R is a hydrocarbyl group contains from about 12 to about 350 carbon atoms. Suitable polyamines for use in preparing the succinimide include, for example, polyalkylene polyamines, including polyalkylene diamines. Such polyalkylene polyamines will typically contain about 2 to about 12 nitrogen atoms and about 2 to 24 carbon atoms. In one embodiment, suitable polyalkylene polyamines are those having the formula: $H_2N—(R^1NH)_c—H$ wherein $R^1$ is a straight- or branched-chain alkylene group having 2 or 3 carbon atoms and c is 1 to 9. Representative examples of suitable polyalkylene polyamines include ethylenediamine, diethylenetriamine, triethylenetetraamine, tetraethylenepentamine and mixtures thereof. Many of the polyamines suitable for use in the present invention are commercially available and others may be prepared by methods which are well known in the art as discussed above.

In one illustrative embodiment, a hydrocarbyl succinimide dispersant to be post treated with a source of boron is obtained by reaction of a PIBSA and a polyamine. In another embodiment, a hydrocarbyl succinimide dispersant to be post treated with a source of boron is obtained by reaction of a PIBSA and a polyamine, wherein the PIBSA is produced from polybutene and maleic anhydride (such as by a thermal reaction method using neither chlorine or a chlorine atom-containing compound). In another embodiment, a hydrocarbyl succinimide dispersant to be post treated with a source of boron is a succinimide reaction product of the condensation reaction between a PIBSA and one or more alkylene polyamines. The PIBSA, in this embodiment, can be the thermal reaction product of high methylvinylidene polyisobutene (PIB) and maleic anhydride.

In one embodiment, a hydrocarbyl succinimide dispersant to be post treated with a source of boron is a primarily bis-succinimide reaction product derived from a PIB having a number average molecular weight (Mn) of about 500 to about 3000. In one embodiment, a PIB has a Mn of from about 700 to 2700. In another embodiment, a hydrocarbyl succinimide dispersant to be post treated with a source of boron is a primarily bis-succinimide reaction product derived from a PIB having a Mn of at least about 600, or at least about 800, or at least about 1000, or at least about 1100, or at least about 1200, or at least about 1300, or at least about 1400, or at least about 1500, or at least about 1600, or at least about 1700, or at least about 1800, or at least about 1900, or at least about 2000, or at least about 2100, or at least about 2200, or at least about 2300, or at least about 2400, or at least about 2500, or at least about 2600, or at least about 2700, or at least about 2800, or at least about 2900, or at least about 3000. In another embodiment, a hydrocarbyl succinimide dispersant to be post treated with a source of boron is a primarily bis-succinimide reaction product derived from a PIB having a Mn of no more than 5000, or no more than about 4000 or no more than about 3500 or no more than about 3000 or no more than about 2700 or no more than about 2500.

In one embodiment, the hydrocarbyl succinimide to be post treated with a source of boron is prepared from a polyisobutenyl succinic anhydride of about 70 to about 128 carbon atoms and tetraethylene pentamine or triethylene tetramine or mixtures thereof.

In one embodiment, the borated hydrocarbyl succinimide dispersant is one in which the foregoing hydrocarbyl succinimide dispersants are treated with a source of boron such that the borated hydrocarbyl succinimide dispersant includes up to 3 wt. % of boron. In one embodiment, the borated hydrocarbyl succinimide dispersant can include from about 2 wt. % or less of boron. In one embodiment, the borated hydrocarbyl succinimide dispersant can include from about 1 wt. % or less of boron. In one embodiment, the borated hydrocarbyl succinimide dispersant can include from about 0.8 wt. % or less of boron. In one embodiment, the borated hydrocarbyl succinimide dispersant can include from about 0.1 or more of boron. In one embodiment, the borated hydrocarbyl succinimide dispersant can include from about 0.5 or more of boron. In one embodiment, the borated hydrocarbyl succinimide dispersant can include from about 0.1 to about 3 wt. % of boron.

Suitable boron compounds that can be used as a source of boron include, for example, boric acid, a boric acid salt, a boric acid ester, and the like. Representative examples of a boric acid include orthoboric acid, metaboric acid, paraboric acid, and the like. Representative examples of a boric acid salt include ammonium borates, such as ammonium metaborate, ammonium tetraborate, ammonium pentaborate, ammonium octaborate, and the like. Representative examples of a boric acid ester include monomethyl borate, dimethyl borate, trimethyl borate, monoethyl borate, diethyl borate, triethyl borate, monopropyl borate, dipropyl borate, tripropyl borate, monobutyl borate, dibutyl borate, tributyl borate, and the like.

In general, the borated hydrocarbyl succinimide dispersant is present in the lubricating oil composition in accordance with the present disclosure in an amount of about 0.5 to about 12 wt. %, based on the total weight of the lubricating oil composition. In another embodiment, the borated hydrocarbyl succinimide dispersant is present in the lubricating oil composition in accordance with the present disclosure in an amount of about 0.5 to about 5 wt. %, based on the total weight of the lubricating oil composition. In another embodiment, the borated hydrocarbyl succinimide dispersant is present in the lubricating oil composition in accordance with the present disclosure in an amount of about 0.5 to about 4 wt. %, based on the total weight of the lubricating oil composition.

The lubricating oil composition in accordance with the present disclosure further includes a hydrocarbyl succinimide post-treated with a post-treating agent selected from the group consisting of an organic carbonate, an epoxide, a lactone, a hydroxyaliphatic carboxylic acid, and combinations thereof. In general, a hydrocarbyl succinimide dispersant to be post treated with the foregoing post-treating agents includes, for example, a hydrocarbyl mono and polysuccinimide. As discussed above, certain fundamental types of succinimides and the related materials encompassed by the term of art "succinimide" are taught in U.S. Pat. Nos. 3,172,892; 3,219,666; and 3,272,746, the disclosures of which are incorporated by reference herein.

In one embodiment, the hydrocarbyl succinimides, because of their commercial availability, are those succinimides prepared from a hydrocarbyl succinic anhydride and a polyamine. Methods for preparing a hydrocarbyl succinimide dispersant are well known in the art as discussed above. For example, a suitable anhydride can be represented by the structure of formula I:

(I)

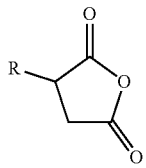

wherein R is a hydrocarbyl group contains from about 12 to about 350 carbon atoms. Suitable polyamines for use in preparing the succinimide include, for example, polyalkylene polyamines, including polyalkylene diamines. Such polyalkylene polyamines will typically contain about 2 to about 12 nitrogen atoms and about 2 to 24 carbon atoms. In one embodiment, suitable polyalkylene polyamines are those having the formula: $H_2N—(R^1NH)_c—H$ wherein $R^1$ is a straight- or branched-chain alkylene group having 2 or 3 carbon atoms and c is 1 to 9. Representative examples of suitable polyalkylene polyamines include ethylenediamine, diethylenetriamine, triethylenetetraamine, tetraethylenepentamine and mixtures thereof. Many of the polyamines suitable for use in the present invention are commercially available and others may be prepared by methods which are well known in the art as discussed above.

In one illustrative embodiment, a hydrocarbyl succinimide dispersant to be post treated with the foregoing post-treating agents is obtained by reaction of a PIBSA and a polyamine. In another embodiment, a hydrocarbyl succinimide dispersant to be post treated with the foregoing post-treating agents is obtained by reaction of a PIBSA and a polyamine, wherein the PIBSA is produced from polybutene and maleic anhydride (such as by a thermal reaction method using neither chlorine or a chlorine atom-containing compound). In another embodiment, a hydrocarbyl succinimide dispersant to be post treated with the foregoing post-treating agents is a succinimide reaction product of the condensation reaction between a PIBSA and one or more alkylene polyamines. The PIBSA, in this embodiment, can be the thermal reaction product of high methylvinylidene polyisobutene (PIB) and maleic anhydride.

In one embodiment, a hydrocarbyl succinimide dispersant to be post treated with the foregoing post-treating agents is a primarily bis-succinimide reaction product derived from a PIB having a number average molecular weight (Mn) of about 500 to about 3000. In one embodiment, a PIB has a Mn of from about 700 to 2700. In another embodiment, a hydrocarbyl succinimide dispersant to be post treated with the foregoing post-treating agents is a primarily bis-succinimide reaction product derived from a PIB having a Mn of at least about 600, or at least about 800, or at least about 1000, or at least about 1100, or at least about 1200, or at least about 1300, or at least about 1400, or at least about 1500, or at least about 1600, or at least about 1700, or at least about 1800, or at least about 1900, or at least about 2000, or at least about 2100, or at least about 2200, or at least about 2300, or at least about 2400, or at least about 2500, or at least about 2600, or at least about 2700, or at least about 2800, or at least about 2900, or at least about 3000. In another embodiment, a hydrocarbyl succinimide dispersant to be post treated with the foregoing post-treating agents is a primarily bis-succinimide reaction product derived from a PIB having a Mn of no more than 5000, or no more than about 4000 or no more than about 3500 or no more than about 3000 or no more than about 2700 or no more than about 2500.

In one embodiment, the hydrocarbyl succinimide to be post treated with the foregoing post-treating agents is prepared from a polyisobutenyl succinic anhydride of about 70 to about 128 carbon atoms and tetraethylene pentamine or triethylene tetramine or mixtures thereof.

Suitable organic carbonates include, for example, cyclic carbonates such as 1,3-dioxolan-2-one (ethylene carbonate); 4-methyl-1,3-dioxolan-2-one(propylene carbonate); 4-ethyl-1,3-dioxolan-2-one(butylene carbonate); 4-hydroxymethyl-1,3-dioxolan-2-one; 4,5-dimethyl-1,3-dioxolan-2-one; 4-ethyl-1,3-dioxolan-2-one; 4,4-dimethyl-1,3-dioxolan-2-one; 4-methyl-5-ethyl-1,3-dioxolan-2-one; 4,5-diethyl-1,3-dioxolan-2-one; 4,4-diethyl-1,3-dioxolan-2-one; 1,3-dioxan-2-one; 4,4-dimethyl-1,3-dioxan-2-one; 5,5-dimethyl-1,3-dioxan-2-one; 5,5-dihydroxymethyl-1,3-dioxan-2-one; 5-methyl-1,3-dioxan-2-one; 4-methyl-1,3-dioxan-2-one; 5-hydroxy-1,3-dioxan-2-one; 5-hydroxymethyl-5-methyl-1,3-dioxan-2-one; 5,5-diethyl-1,3-dioxan-2-one; 5-methyl-5-propyl-1,3-dioxan-2-one; 4,6-dimethyl-1,3-dioxan-2-one; 4,4,6-trimethyl-1,3-dioxan-2-one and spiro[1,3-oxa-2-cyclohexanone-5,5'-1',3'-oxa-2'-cyclohexanone]. Other suitable cyclic carbonates may be prepared from sacchrides such as sorbitol, glucose, fructose, galactose and the like and from vicinal diols prepared from $C_1$ to $C_{30}$ olefins by methods known in the art.

Suitable epoxides include, for example, an epoxide represented by the following structure:

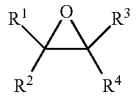

wherein $R^1$, $R^2$, $R^3$ and $R^4$ may be independently hydrogen or a hydrocarbyl group containing from 1 to 50 carbon atoms. In one embodiment, a suitable epoxide includes, for example, ethylene oxide, propylene oxide, butylene oxide, styrene oxide and combinations thereof.

Suitable lactones include, for example, those having from 3 to about 12 carbon atoms in the main ring. In one embodiment, a suitable lactone is, for example, caprolactone. Other cyclic lactones for use herein can be those disclosed in, for example, U.S. Pat. Nos. 4,617,138; 4,645,515; 4,668,246; 4,963,275; and 4,971,711.

Suitable hydroxyaliphatic carboxylic acids include, for example, an alpha-hydroxyaliphatic carboxylic acid compound represented by the following structure:

$$R^5—CH(OH)—COOH$$

wherein $R^5$ is a hydrocarbyl group having from 1 to about 30 carbon atoms. Representative examples of alpha-hydroxyaliphatic carboxylic acid compounds include alpha-hydroxydodecanoic acid, alpha-hydroxytetradecanoic acid, alpha-hydroxyhexadecanoic acid, alpha-hydroxyoctadecanoic acid, alpha-hydroxypentadecanoic acid, alpha-hydroxyeicosanoic acid, alpha-hydroxydocosanoic acid, alpha-hydroxytetracosanoic acid, alpha-hydroxyhexacosanoic acid, alpha-hydroxyoctacosanoic acid, and the like. Other hydroxyaliphatic carboxylic acids can be those disclosed in U.S. Pat. Nos. 4,482,464; 4,521,318; and 4,713,189.

Methods for preparing the hydrocarbyl succinimide post-treated with a post-treating agent selected from the group consisting of an organic carbonate, an epoxide, a lactone, a hydroxyaliphatic carboxylic acid, and combinations thereof are well known in the art. For example, a cyclic carbonate post-treatment can be conducted under conditions sufficient to cause reaction of the cyclic carbonate with secondary amino groups of the polyamino substituents. Typically, the reaction is conducted at temperatures of about 0° C. to about 250° C., or from about 100° C. to about 200° C. The reaction may be conducted neat, and may or may not be conducted in the presence of a catalyst (such as an acidic, basic or Lewis acid catalyst). Depending on the viscosity of the reactants, it may be desirable to conduct the reaction using an inert organic solvent or diluent, e.g., toluene or xylene.

In general, the hydrocarbyl succinimide post-treated with a post-treating agent selected from the group consisting of an organic carbonate, an epoxide, a lactone, a hydroxyaliphatic carboxylic acid, and combinations thereof is present in the lubricating oil composition in accordance with the present disclosure in an amount of about 0.5 wt. % to about 12 wt. %, based on the total weight of the lubricating oil composition. In another embodiment, the hydrocarbyl succinimide post-treated with a post-treating agent selected from the group consisting of an organic carbonate, an epoxide, a lactone, a hydroxyaliphatic carboxylic acid, and combinations thereof is present in the lubricating oil composition in accordance with the present disclosure in an amount of about 0.5 wt. % to about 5 wt. %, based on the total weight of the lubricating oil composition. In another embodiment, the hydrocarbyl succinimide post-treated with a post-treating agent selected from the group consisting of an organic carbonate, an epoxide, a lactone, a hydroxyaliphatic carboxylic acid, and combinations thereof is present in the lubricating oil composition in accordance with the present disclosure in an amount of about 0.5 wt. % to about 4 wt. %, based on the total weight of the lubricating oil composition.

In general, the dispersant mixture of a hydrocarbyl succinimide dispersant; (c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof can provide a TBN to the lubricating oil composition of from about 0.5 to about 5. In one embodiment, the dispersant mixture of a hydrocarbyl succinimide dispersant; (c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof can provide a TBN to the lubricating oil composition of from about 0.9 to about 4.2.

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, detergents such as metal detergents, rust inhibitors, dehazing agents, demulsifying agents, metal deactivating agents, friction modifiers, antiwear agents, pour point depressants, antifoaming agents, co-solvents, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Representative examples of metal detergents include sulphonates, alkylphenates, sulfurized alkylphenates, carboxylates, salicylates, phosphonates, and phosphinates. Commercial products are generally referred to as neutral or overbased. Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

In one embodiment, the one or more overbased detergents may have a TBN (oil free basis) of 0 to about 60. In another embodiment, the one or more overbased detergents can have a TBN (oil free basis) of greater than 60 to about 200. In another embodiment, the one or more overbased detergents can have a TBN (oil free basis) of greater than about 200 to about 800.

Examples of antiwear agents include, but are not limited to, zinc dialkyldithiophosphates and zinc diaryldithiophosphates, e.g., those described in an article by Born et al. entitled "Relationship between Chemical Structure and Effectiveness of Some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

In the preparation of lubricating oil formulations, it is common practice to introduce the additives in the form of about 10 to about 80 wt. % active ingredient concentrates in hydrocarbon oil, e.g. mineral lubricating oil, or other suitable solvent.

Usually these concentrates may be diluted with about 3 to about 100, e.g., about 5 to about 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, or from about 0.005 wt. % to about 15 wt. %, or from about 0.01 wt. % to about 10 wt. %, or from about 0.1 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, or from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Specific details described in each example should not be construed as necessary features of the disclosure. The following examples are intended for illustrative purposes only and do not limit in any way the scope of the present disclosure. All numerical values are approximate. When numerical ranges are given, it should be understood that embodiments outside the stated ranges may still fall within the scope of the disclosure.

Preparation of Dispersant-A

A succinimide-type dispersant was prepared by thermal reaction process using polybutene of a number-average molecular weight of approx. 1,300 and maleic anhydride and by the reaction with polyalkylene polyamine having a mean nitrogen atom number of 6.5 (per one molecule).

Preparation of Dispersant-B

A borated succinimide-type dispersant was prepared by thermal reaction process using polybutene of a number-average molecular weight of approx. 1,300 and maleic anhydride, with polyalkylene polyamine having a mean nitrogen atom number of 6.5 (per one molecule), and by the treatment of the resulting succinimide with boric acid, according to U.S. Pat. No. 5,356,552.

Preparation of Dispersant-C

An ethylene carbonate-treated succinimide-type dispersant was prepared by the thermal reaction process using polybutene of a number-average molecular weight of approx. 2,300 and maleic anhydride, by the reaction with polyalkylene polyamine having a mean nitrogen atom number of 6.5 (per one molecule), and by the treatment of the resulting succinimide with ethylene carbonate, according to U.S. Pat. No. 5,356,552.

Example 1

A lubricating oil composition was prepared that contained a major amount of a base oil of lubricating viscosity and the following additives, to provide a finished oil having an SAE viscosity of 15W-40:

1.30 wt. % of dispersant-A;

1.05 wt. % of dispersant-B;

0.95 wt. % dispersant-C;

a mixture of calcium sulfonate and phenate detergents;

990 ppm in terms of phosphorus content, of a secondary zinc dialkyldithiophosphate;

a molybdenum succinimide antioxidant;

an alkylated diphenylamine;

5 ppm in terms of silicon content, of a foam inhibitor;

a non-dispersant olefin copolymer viscosity modifier; and the remainder, a Group II base oil, wherein the TBN in the lubricating oil composition from the dispersants A, B and C is 2.21.

Comparative Example 1

A lubricating oil composition was prepared that contained a major amount of a base oil of lubricating viscosity and the following additives, to provide a finished oil having an SAE viscosity of 15W-40:

2.85 wt. % of dispersant-C;

a mixture of calcium sulfonate and phenate detergents;

990 ppm in terms of phosphorus content, of a secondary zinc dialkyldithiophosphate;

a molybdenum succinimide antioxidant;

an alkylated diphenylamine;

5 ppm in terms of silicon content, of a foam inhibitor;

a non-dispersant olefin copolymer viscosity modifier; and the remainder, a Group II base oil, wherein the TBN in the lubricating oil composition from the dispersants A, B and C is 0.94.

Comparative Example 2

A lubricating oil composition was prepared that contained a major amount of a base oil of lubricating viscosity and the following additives, to provide a finished oil having an SAE viscosity of 15W-40:

3.89 wt. % of dispersant A;

a mixture of calcium sulfonate and phenate detergents;

990 ppm in terms of phosphorus content, of a secondary zinc dialkyldithiophosphate;

a molybdenum succinimide antioxidant;

an alkylated diphenylamine;

5 ppm in terms of silicon content, of a foam inhibitor;

a non-dispersant olefin copolymer viscosity modifier; and the remainder, a Group II base oil, wherein the TBN in the lubricating oil composition from the dispersants A, B and C is 3.22.

Comparative Example 3

A lubricating oil composition was prepared that contained a major amount of a base oil of lubricating viscosity and the following additives, to provide a finished oil having an SAE viscosity of 15W-40:

3.15 wt. % of dispersant-B;

a mixture of calcium sulfonate and phenate detergents;

990 ppm in terms of phosphorus content, of a secondary zinc dialkyldithiophosphate;

a molybdenum succinimide antioxidant;

an alkylated diphenylamine;

5 ppm in terms of silicon content, of a foam inhibitor;

a non-dispersant olefin copolymer viscosity modifier; and the remainder, a Group II base oil, wherein the TBN in the lubricating oil composition from the dispersants A, B and C is 2.47.

T-8E Screener Test

Mack T-8E screener is based on a Mack T-11 engine, with EGR close to 0, ran for 144 h. Same temperatures, speed, fuel as T-11 (ASTM D7156) except Target soot is set at 4% after 108 h. KV100 and soot by TGA is measured every 12 hours, initial KV100 after 30 cycles shear viscosity is also measured to start to be able to calculate RV100 @ 100% soot.

Heavy Duty Commercial Diesel Soot Handling—Mack T8 Test

The Mack T8 engine test is an established test for determining the ability of a lubricant to control viscosity changes caused by soot that is produced as a by-product from the combustion process of modern heavy duty truck diesel engines. The test also evaluates sludge and oil consumption. The critical parameter is the viscosity increase in the lubricant at 4% soot in oil, measured by Thermogravimetric analysis (TGA). The required level of soot may be achieved before the end of the test (250 hours). At the end of the test, the soot and viscosity increase are measured. These measurements are used as a measure of oil performance.

Details of Mack T8 Test (ASTM 4485)

Equipment: Mack E7-350, six cylinder turbocharged, intercooled diesel engine 12.0 litres, 350 BHP.

Purpose: Evaluation of viscometric performance and soot loading of engine oils in turbocharged and intercooled diesel engines.

Details of Mack T8 Test (ASTM 4485)

| | | |
|---|---|---|
| Test Conditions: | Duration, hrs | 250 at full load |
| | Speed, rpm | 1800 |
| | Torque, lb/ft | 1010-1031 |
| | Oil sump temp,° C. | 102-107 |
| | Coolant out temp, ° C. | 85 |
| | Fuel | 0.03-0.05% |

-continued

| | Sulphur |
|---|---|

Method of Rating: Viscosity increases from used oil in analysis are measured. Test method also stipulates max. oil consumption of 0.0005 lbs/BHP/hr.

In Table 1 below, we followed a screener Mack T8 Test to compare relative performance of the lubricating oil composition of Example 1 with the lubricating oil composition of Comparative Examples 1-3.

Fluorocarbon Elastomer Seal Compatibility (AK6)

The lubricating oil compositions of Example 1 and Comparative Examples 1-3 were tested for compatibility with fluorocarbon elastomer seals in a Daimler Chrysler bench test (PV 3344) by suspending a fluorocarbon test piece (AK 6) in an oil-based solution heated to 150° C. for 168 hours. The variation in the percent volume change, points hardness change (PH), the percent tensile strength change (TS) and the percent elongation change (EL) of each sample was measured. The passing limits for are summarized below.

Passing Limit

| | |
|---|---|
| Vol. Change (%) | ≤0.5 |
| PH Change | ≤5 |
| TS Change (%) | ≥−50 |
| EL Change (%) | ≥−55 |

The test results for the compatability test are summarized below in Table 1.

TABLE 1

| | Ex. 1 | Comp. Ex. 1 | Comp. Ex. 2 | Comp. Ex. 3 |
|---|---|---|---|---|
| TBN D2896 | | | | |
| | 11.9 | 10.6 | 12.9 | 12.2 |
| T8E Screener | | | | |
| Rv100[1] at 100° C. @ 4% soot | 1.80 | 1.80 | 2.15 | 2.40 |

[1]Rv100 is Relative viscosity. Rv100 = Kv100/(Kv100 after bosch 30 cycles).

It will be understood that various modifications may be made to the embodiments disclosed herein. Therefore, the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising:

(a) a major amount of an oil of lubricating viscosity having a kinematic viscosity at 100° C. in a range of about 2 to about 50 $mm^2/s$;

(b) a non-borated hydrocarbyl succinimide dispersant;

(c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

2. The lubricating oil composition of claim 1, wherein the major amount of the oil of lubricating viscosity is greater than 50 wt. %, based on the total weight of the lubricating oil composition.

3. The lubricating oil composition of claim 1, wherein the hydrocarbyl group of the (b) hydrocarbyl succinimide dispersant contains from about 12 to about 350 carbon atoms.

4. The lubricating oil composition of claim 1, wherein the (b) hydrocarbyl succinimide dispersant is a polyalkenyl succinimide.

5. The lubricating oil composition of claim 4, wherein the polyalkenyl succinimide is a polyisobutenyl bis-succinimide.

6. The lubricating oil composition of claim 5, wherein the polyisobutenyl bis-succinimide is derived from a polyisobutylene group having a number average molecular weight of about 700 to about 2,500.

7. The lubricating oil composition of claim 1, wherein the (c) borated hydrocarbyl succinimide dispersant is a borated polyalkenyl succinimide.

8. The lubricating oil composition of claim 7, wherein the borated polyalkenyl succinimide is a borated polyisobutenyl bis-succinimide.

9. The lubricating oil composition of claim 1, wherein the borated polyisobutenyl bis-succinimide is derived from a polyisobutylene group having a number average molecular weight of about 700 to about 2,500.

10. The lubricating oil composition of claim 1, wherein the hydrocarbyl succinimide (d) is post-treated with an organic carbonate.

11. The lubricating oil composition of claim 10, wherein the organic carbonate is ethylene carbonate.

12. The lubricating oil composition of claim 1, comprising:

from about 0.5 wt. % to about 12 wt. %, based on the total weight of the lubricating oil composition, of the hydrocarbyl succinimide dispersant; from about 0.5 wt. % to about 12 wt. %, based on the total weight of the lubricating oil composition, of the borated hydrocarbyl succinimide dispersant; and from about 0.5 wt. % to about 12 wt. %, based on the total weight of the lubricating oil composition, of the hydrocarbyl succinimide post-treated with a post-treating agent selected from the group consisting of an organic carbonate, an epoxide, a lactone, a hydroxyaliphatic carboxylic acid.

13. The lubricating oil composition of claim 1, wherein a mixture of the hydrocarbyl succinimide dispersant; the borated hydrocarbyl succinimide dispersant; and the hydrocarbyl succinimide post-treated with a post-treating agent selected from the group consisting of an organic carbonate, an epoxide, a lactone, a hydroxyaliphatic carboxylic acid, and combinations thereof provides a total base number (TBN) to the lubricating oil composition of from about 0.5 to about 5.

14. The lubricating oil composition of claim 1, further comprising at least one additive selected from the group consisting of antioxidants, metallic detergents, rust inhibitors, dehazing agents, demulsifying agents, metal deactivating agents, friction modifiers, pour point depressants, anti-foaming agents, co-solvents, corrosion-inhibitors, multifunctional agents, dyes, extreme pressure agents and mixtures thereof.

15. A method comprising operating an internal combustion engine with a lubricating oil composition comprising (a) a major amount of an oil of lubricating viscosity having a kinematic viscosity at 100° C. in a range of about 2 to about 50 $mm^2/s$;

(b) a non-borated hydrocarbyl succinimide dispersant;

(c) a borated hydrocarbyl succinimide dispersant; and (d) a hydrocarbyl succinimide post-treated with a post-treating agent selected from the group consisting of an organic carbonate, an epoxide, a lactone, a hydroxyaliphatic carboxylic acid, and combinations thereof.

16. The method of claim 15, wherein the hydrocarbyl succinimide is a polyisobutenyl bis-succinimide derived from a polyisobutylene group having a number average molecular weight of about 700 to about 2,500.

17. The method of claim 15, wherein the (c) borated hydrocarbyl succinimide is a borated polyisobutenyl bis-succinimide derived from a polyisobutylene group having a number average molecular weight of about 700 to about 2,500.

18. The method of claim 15, wherein the hydrocarbyl succinimide (d) is post-treated with an organic carbonate which is ethylene carbonate.

19. The method of claim 15, wherein the lubricating oil composition comprises:

from about 0.5 wt. % to about 12 wt. %, based on the total weight of the lubricating oil composition, of the hydrocarbyl succinimide dispersant; from about 0.5 wt. % to about 12 wt. %, based on the total weight of the lubricating oil composition, of the borated hydrocarbyl succinimide dispersant; and from about 0.5 wt. % to about 12 wt. %, based on the total weight of the lubricating oil composition, of the hydrocarbyl succinimide post-treated with a post-treating agent selected from the group consisting of an organic carbonate, an epoxide, a lactone, a hydroxyaliphatic carboxylic acid.

20. The method of claim 15, wherein the lubricating oil composition further comprises at least one additive selected from the group consisting of antioxidants, metallic detergents, rust inhibitors, dehazing agents, demulsifying agents, metal deactivating agents, friction modifiers, pour point depressants, antifoaming agents, co-solvents, corrosion-inhibitors, multifunctional agents, dyes, extreme pressure agents and mixtures thereof.

* * * * *